US012338709B2

(12) United States Patent
Goodwin et al.

(10) Patent No.: US 12,338,709 B2
(45) Date of Patent: Jun. 24, 2025

(54) MULTI-POSITION SLEEVE ASSEMBLY, SYSTEMS, AND METHODS FOR USE IN A WELLBORE

(71) Applicant: KOBOLD CORPORATION, Calgary (CA)

(72) Inventors: Sean Goodwin, Calgary (CA); Per Angman, Calgary (CA); Scott Sherman, Blackie (CA)

(73) Assignee: KOBOLD CORPORATION, Calgary (CA)

( * ) Notice: Subject to any disclaimer, the term of this patent is extended or adjusted under 35 U.S.C. 154(b) by 161 days.

(21) Appl. No.: 18/218,402

(22) Filed: Jul. 5, 2023

(65) Prior Publication Data

US 2024/0011370 A1 Jan. 11, 2024

Related U.S. Application Data

(60) Provisional application No. 63/359,247, filed on Jul. 8, 2022.

(51) Int. Cl.
*E21B 34/14* (2006.01)

(52) U.S. Cl.
CPC ..... *E21B 34/14* (2013.01)

(58) Field of Classification Search
CPC ..... E21B 34/14; E21B 34/142
See application file for complete search history.

(56) References Cited

U.S. PATENT DOCUMENTS 4,151,881 A * 5/1979 Armstrong ..... E21B 41/00 166/373
10,472,928 B2 11/2019 Andreychuk et al.
11,208,871 B2 12/2021 Shpak et al.
11,346,169 B2 5/2022 Andreychuk et al.
2014/0014340 A1* 1/2014 King ..... E21B 43/28 166/194
2015/0211316 A1* 7/2015 Skjeie ..... E21B 34/14 166/99
2019/0242215 A1* 8/2019 Johnson ..... E21B 34/14
2020/0408068 A1* 12/2020 Mackay ..... E21B 34/103
2023/0407732 A1* 12/2023 Graham ..... E21B 34/14

FOREIGN PATENT DOCUMENTS

CA 2916168 C 6/2016

OTHER PUBLICATIONS

"Terrus retrofit water-injection system." NCS Multistage LLC. https://www.ncsmultistage.com/wp-content/uploads/2021/03/Terrus-Product-Sheet-052020.pdf.

* cited by examiner

*Primary Examiner* — Kristyn A Hall
(74) *Attorney, Agent, or Firm* — Parlee McLaws LLP

(57) ABSTRACT

A multi-position sleeve assembly for use in a wellbore, comprising a tubular housing defining an axial bore, a first sliding sleeve, and a second sliding sleeve. The housing has an inner and outer surface defining therebetween one or more first ports and one or more second ports spaced axially from the one or more first ports. The one or more second ports are configured for restricted fluid flow relative to the one or more first ports. The first and second sliding sleeves are located in the bore and coaxial to the housing and are actuable relative to the housing between a closed sleeve position, wherein the one or more first ports and the one or more second ports are obstructed, and an open sleeve position wherein, one or both of the one or more first ports and the one or more second ports are not obstructed.

18 Claims, 12 Drawing Sheets

MULTI-POSITION SLEEVE ASSEMBLY, SYSTEMS, AND METHODS FOR USE IN A WELLBORE

CROSS REFERENCE TO RELATED APPLICATIONS

This application claims the benefit of U.S. Provisional Application No. 63/359,247 filed Jul. 8, 2022 and entitled "MULTI-POSITION SLEEVE ASSEMBLY, SYSTEMS, AND METHODS FOR USE IN A WELLBORE," the entirety of which is hereby incorporated by reference.

FIELD

Embodiments taught herein are related to apparatus, systems, and methods for use in wellbore completion operations, and, more particularly, to shiftable sleeves for opening and closing ports located along a tubular, such as wellbore casing.

BACKGROUND

It is known to position shifting sleeve assemblies axially along a wellbore casing string for opening and closing ports therealong to facilitate treatment of an underground formation, such as in a fracturing operation. The sleeve assemblies typically comprise a generally tubular sleeve housing having an inner sleeve releasably retained therein. The sleeve can be actuated to axially slide within the housing to selectably open and block housing ports extending radially through the housing. Sleeve assemblies are spaced along the casing string such that they are adjacent to respective treatment zones, or other zones of interest, once the casing has been set in the wellbore.

The sleeve assemblies can be actuated using an actuating tool run into the wellbore from surface. For example, the actuating tool can be run-in-hole to below the downhole-most sleeve assembly and operated to actuate the sleeve to the open position. At least one sealing means, such as a packer, is employed by the actuating tool to isolate the balance of the wellbore from the treatment fluids, such as the wellbore downhole of the sleeve being actuated. Fluid is then introduced into the wellbore and directed into the formation through the open housing ports for treatment of the treatment zone adjacent to the sleeve assembly. Once treatment is complete, the actuating tool can be repositioned to the next sleeve assembly, uphole of the just-actuated sleeve assembly, and operated to actuate the next sleeve assembly to the open position, the process continuing until all desired treatment zones have been treated.

Many different types of sleeves and actuating tools are known in the industry. Applicant's U.S. Pat. No. 10,472,928 discloses a downhole actuator tool for locating and actuating one or more sleeve valves spaced along a completion string. Applicant's U.S. Pat. No. 11,346,169 discloses a shift uphole-to-open sleeve assembly for insertion along a tubular string for multi-stage, selectable wellbore treatment.

There is interest in improved sleeve assemblies having the ability to restrict or meter the amount of flow between the housing bore and the surrounding formation and that are suitable for manipulation using downhole actuator tools.

SUMMARY

Embodiments of a multi-position sleeve assembly described herein comprise a tubular housing defining one or more first ports and one or more second ports, the one or more second ports configured for restricted fluid flow relative to the one or more first ports. The sleeve assembly can be positioned along a casing string extending into a wellbore from surface and located adjacent a corresponding treatment zone of a subterranean formation.

In some embodiments, the present disclosure relates to a multi-position sleeve assembly comprising a tubular housing defining a bore axially therethrough, the housing having an inner surface and an outer surface and defining one or more first ports and one or more second ports from the inner surface to the outer surface, the one or more second ports spaced axially from the one or more first ports; a first sliding sleeve located in the bore and coaxial with the housing, the first sliding sleeve axially actuable relative to the housing between a closed first sleeve position wherein the first sliding sleeve obstructs the one or more first ports, and an open first sleeve position wherein the first sliding sleeve does not obstruct the one or more first ports; and a second sliding sleeve located in the bore and coaxial with the housing, the second sliding sleeve axially actuable relative to the housing between a closed second sleeve position wherein the second sliding sleeve obstructs the one or more second ports, and an open second sleeve position wherein the second sliding sleeve does not obstruct the one or more second ports, wherein the one or more second ports are configured for restricted fluid flow relative to the one or more first ports.

In some embodiments, the second sliding sleeve is positioned downhole relative to the first sliding sleeve.

In some embodiments, the one or more first ports comprise two or more first ports.

In some embodiments, the two or more first ports are circumferentially arranged about the housing.

In some embodiments, the two or more first ports encircle the longitudinal axis of the housing.

In some embodiments, the one or more second ports comprise two or more second ports.

In some embodiments, the two or more second ports are circumferentially arranged about the housing.

In some embodiments, the two or more second ports encircle the longitudinal axis of the housing.

In some embodiments, when the first sliding sleeve is in the open first sleeve position and the second sliding sleeve is in the open second sleeve position, the second sliding sleeve obstructs the one or more first ports.

In some embodiments, the one or more second ports have a diameter between about 0.040 inch and about 0.375 inch and in particular 0.0625 inch.

In some embodiments, the one or more second ports have a tapered profile from the outer surface to the inner surface.

In some embodiments, the one or more second ports have a countersink hole profile.

In some embodiments, the multi-position sleeve assembly further comprises one or more removable plugs, each plug for occupying one of the one or more second ports prior to first use.

In some embodiments, the one or more plugs comprise rubber.

In some embodiments, the outer surface of the housing further defines one or more axial grooves, each axial groove extending between a respective one of the one or more first ports and a respective one of the one or more second ports.

In some embodiments, the multi-position sleeve assembly further comprises a helical groove defined in the outer surface of the housing, and circumferentially arranged about the outer surface and axially extending along a portion of the outer surface, the helical groove being connected to a metering hole defined between the inner surface and the outer surface of the housing; and a sleeve configured to be circumferentially arranged about the helical groove and exposing open ends of the helical groove, the sleeve and helical groove together defining a closed fluid pathway therethrough on the outer surface of the housing.

In some embodiments, the multi-position sleeve assembly further comprises a sleeve configured to be circumferentially arranged about the outer surface of the housing and axially extending along a portion of the outer surface, the sleeve defining a helical groove and opens ends of the helical groove, the helical groove being connected to a metering hole defined between the inner surface and the outer surface of the housing, and the sleeve and helical groove together defining a closed fluid pathway therethrough on the outer surface of the housing.

In some embodiments, the present disclosure relates to a method of actuating the multi-position sleeve assemblies disclosed herein, the method comprising: actuating the first sliding sleeve from the closed first sleeve position to the open first sleeve position; and actuating the second sliding sleeve from the closed second sleeve position to the open second sleeve position.

In some embodiments, the one or more second ports are not obstructed and the second sliding sleeve obstructs the one or more first ports in the open second sleeve position.

Other aspects and features of the present disclosure will become apparent to those ordinarily skilled in the art, upon review of the following description of the specific embodiments of the disclosure.

BRIEF DESCRIPTION OF THE DRAWINGS

The present disclosure will be better understood having regard to the drawings in which.

DETAILED DESCRIPTION

The present disclosure relates to a multi-position sleeve assembly for installation along a casing string extending from surface into a wellbore to control fluid flow between a bore of the casing string and corresponding treatment zones surrounding the sleeve assembly. The present disclosure also relates to systems comprising the multi-position sleeve assembly and methods of actuating inner sleeves of the sleeve assembly.

Unless otherwise specified, the term "uphole" as used herein means along a drill string or a wellbore in a formation from a distal end thereof towards the surface, and the term "downhole" as used herein means along the drill string or the wellbore from the surface towards the distal end. Use of any one or more of the foregoing terms does not necessarily denote positions along a vertical axis, since the wellbore and drill string may not be vertical.

Figure 1A:
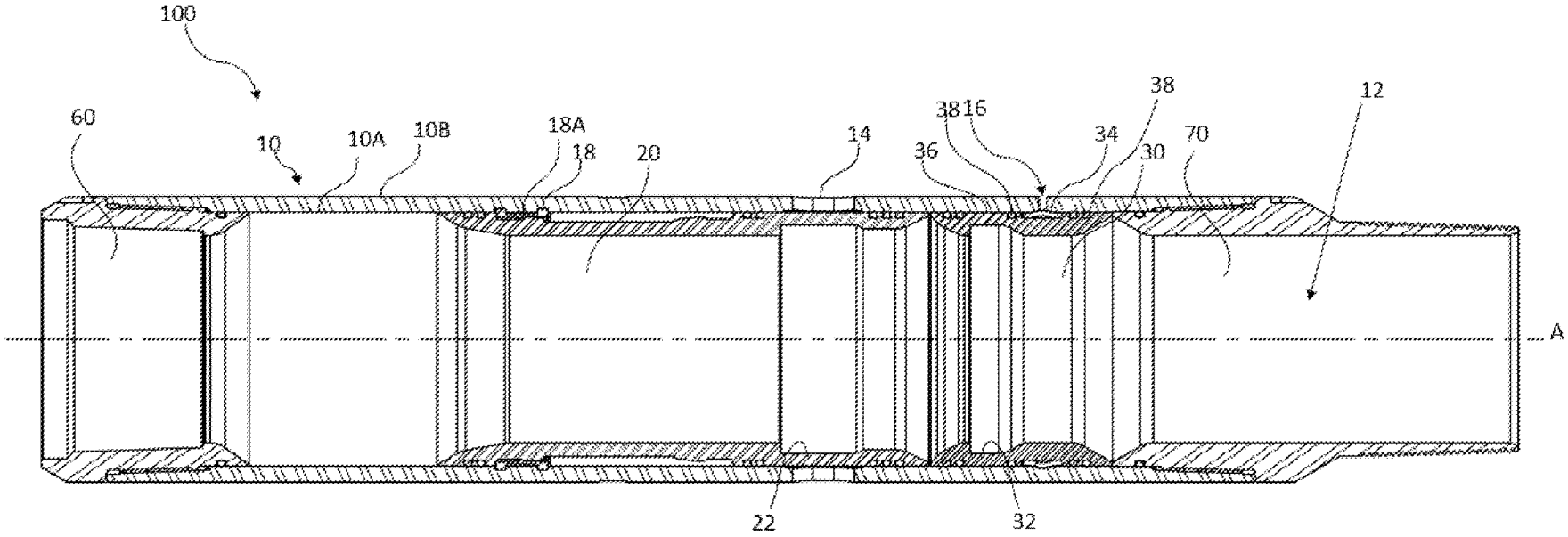
FIGS. 1A, 1B, and 1C are side cross-section views of a multi-position sleeve assembly, according to some embodiments, in a first, second, and a third mode, respectively.
Figure 1B:
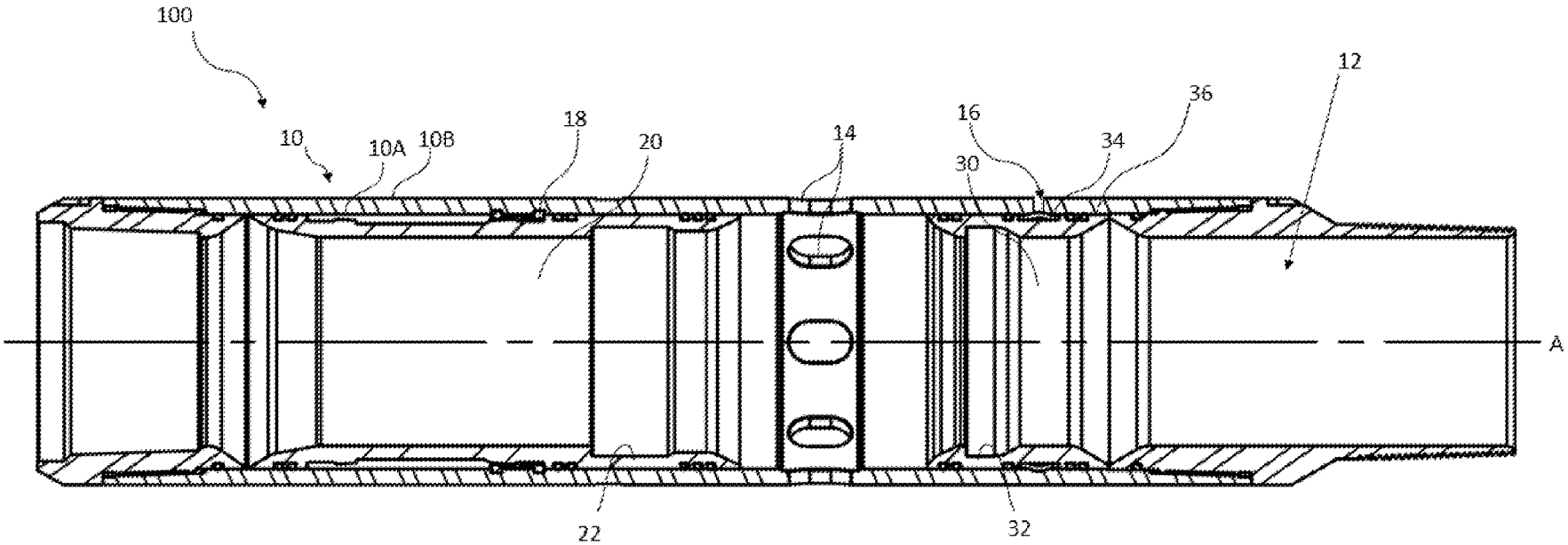
Figure 1C:
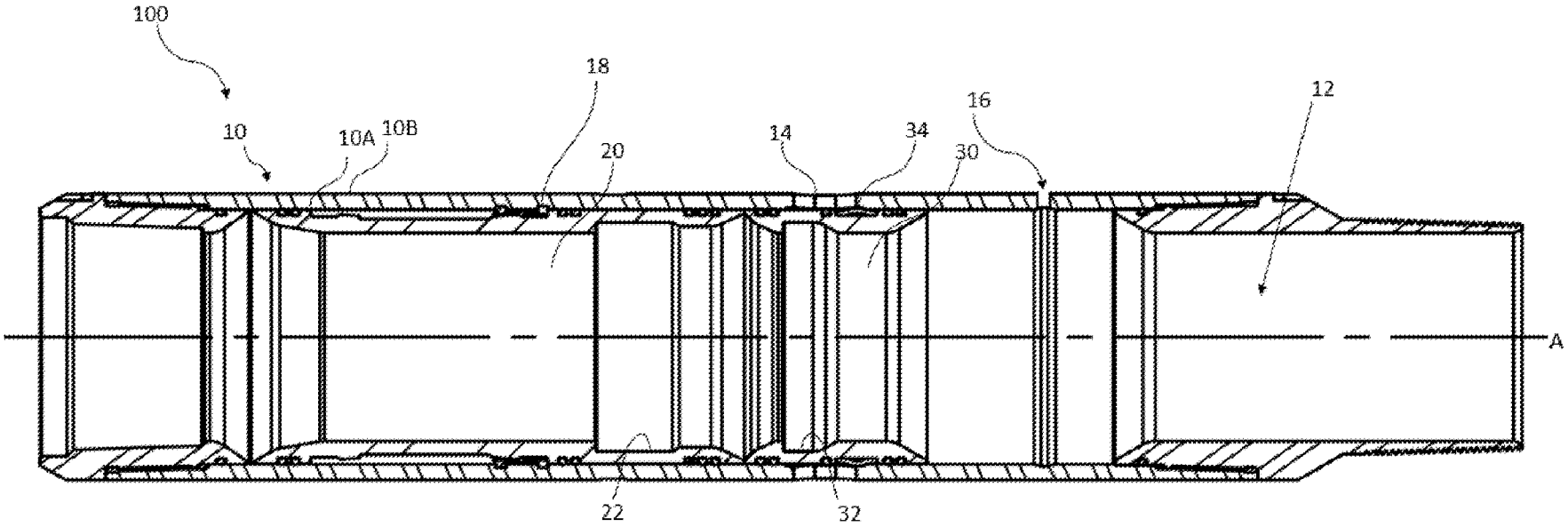

Referring to FIGS. 1A to 1C, a multi-position sleeve assembly 100 comprises a tubular housing 10 having an inner surface 10A and an outer surface 10B and defining a bore 12 axially therethrough. The housing 10 defines one or more first ports 14 and one or more second ports 16 from the inner surface 10A to the outer surface 10B, the one or more second ports 16 axially spaced from the one or more first ports 14. By "axially spaced" it is meant that the one or more first ports 14 and the one or more second ports 16 are separated from each other along the length of the housing 10. In some embodiments, the one or more first ports 14 and the one or more second ports 16 may be axially spaced between about 3 inches and about 5 inches measured from the center of one of the one or more first ports to the center of a respective one or more second port. Both the one or more first ports 14 and the one or more second ports 16 are for allowing fluid, such as for example fracturing fluid, stimulation fluids, produced water, acid, hydrocarbons, and other products used in enhanced oil recovery, to flow from the bore 12 to a surrounding treatment zone.

The one or more second ports 16 may be configured for restricted fluid flow relative to the one or more first ports 14. As used herein, "configured for restricted fluid flow" is intended to mean that the flow rate of a fluid passing through the one or more second ports 16 is less than the flow rate of the same fluid if it passed through the one or more first ports 14. The restricted fluid flow may be a metered fluid flow, in that the one or more second ports 16 may allow fluid flow therethrough at an approximately known rate. Thus, the one or more second ports 16 may be referred to as "metering ports" in some embodiments. The restricted fluid flow may be determined by the dimensions of the one or more second ports 16. In some embodiments, the one more second ports 16 have a diameter between about 0.040 inch and about 0.375 inch. This may allow flow at an approximately fixed injection rate into a formation that is less than the rate through the one or more first ports 14. In some embodiments, approximately evenly distributed flow into the one or more second ports 16 may be achieved by a pressure drop that is at least about six times the pressure drop experienced flowing along the casing of the completion in which the multi-position sleeves 100 are installed. In some embodiments, the diameter of the one or more second ports 16 is 0.0625 inch. The 0.0625 inch diameter may allow a flow of 20 cubic meters of fluid per day through the one or more second ports 16.

Figure 2A:
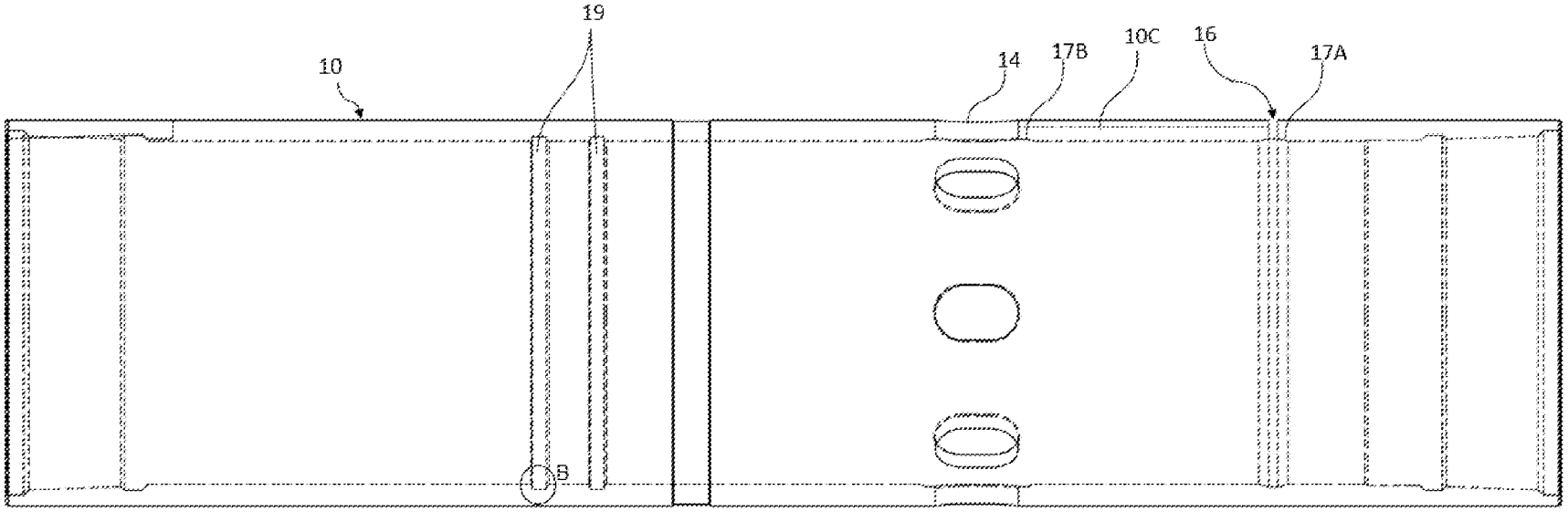
FIG. 2A is side view of a tubular housing of the sleeve assembly of FIGS. 1A to 1C.

In some embodiments, the one or more first ports 14 comprise two or more first ports 14 that may be circumferentially arranged about the housing 10. In some embodiments, the one or more first ports 14 encircle the longitudinal axis A of the housing 10. In some embodiments, the one or more second ports 16 comprise two or more first ports 16 that may be circumferentially arranged about the housing 10. In a particular embodiment, the one or more second ports 14 encircle the longitudinal axis A of the housing 10. As used herein, the phrase "encircle the longitudinal axis" is intended to refer to the one or more first and/or second ports 14. 16 being arranged in a circular or substantially circular pattern around the housing 10 such as, for example, as indicated for the one or more first ports 14 in FIG. 2A.

A first sliding sleeve 20 and a second sliding sleeve 30 are located in the bore 12 and coaxial with the housing 10 and are axially actuable relative to the housing 10. In some embodiments, the second sliding sleeve 30 is positioned downhole relative to the first sliding sleeve 20.

The first sliding sleeve 20 is actuable within the housing 10 for axial movement between a closed first sleeve position, wherein the one or more first ports 14 are obstructed by the first sliding sleeve 20, and an open first sleeve position, wherein the first sliding sleeve 20 does not obstruct the one or more first ports 14. The second sliding sleeve 30 is actuable within the housing 10 between a closed second sleeve position, wherein the one or more second ports 16 are obstructed by the second sliding sleeve 30, and an open second sleeve position, wherein the second sliding sleeve 30 does not obstruct the one or more second ports 16. As used herein, the phrase "obstructed by the (first/second) sliding sleeve" and the related terms "obstructs" and "obstructing" refers to the one or more first/second ports being blocked or substantially blocked such that fluid communication between the bore 12 and the surrounding environment such as, for example, the surrounding treatment area, is prevented or substantially prevented. Conversely, "does not obstruct the one or more (first/second) ports" and the related expression "not obstructed" as used herein refers to fluid communication between the bore 12 and surrounding environment such as, for example, the surrounding treatment area, being permitted through the one or more first and/or second ports 14, 16. It will be appreciated that prevention or blocking of fluid communication between the bore 12 and the surrounding treatment area through the one or more first ports 14 and/or the one or more second ports 16 may be desirable when the first and/or second sliding sleeves 20, 30 are in the respective closed sleeve positions. Blocking of fluid communication between the bore 12 and the surrounding treatment area is, for example, needed when cementing during well construction.

In some embodiments, when the first sliding sleeve 20 is in the open first sleeve position and the second sliding sleeve 30 is in the open second sleeve position, the second sliding sleeve 30 obstructs the one or more first ports 14. In these embodiments, when used in a wellbore, fluid may flow from the bore 12, through the one or more second ports 16, and through a microannulus formed between the housing 10 and a cement sheath around the housing 10, towards the treatment area proximal the one or more first ports 14. In some embodiments, the outer surface 10B of the housing 10 may define one or more axial grooves 10C, each axial groove extending between a respective one of the one or more first ports 14 and a respective one of the one or more second ports 16 (see, for example, FIG. 2A). The one or more axial grooves 10C may be of any suitable shape and size. Without being bound by any particular theory, the one or more axial grooves 10C may facilitate fluid flow from the one or more second ports 16 to the surrounding treatment area proximal the one or more first ports 14 by providing a preferential axial flow path.

In alternate embodiments, the one or more first ports 14 are not obstructed by the second sliding sleeve 30 when the second sliding sleeve 30 is in the open second sleeve position. That is, in the open second sleeve position, the second sliding sleeve 30 may not block the one or more first ports 14, and the first sliding sleeve 20 may still be moved between its closed and open first sleeve positions. Thus, in such embodiments, the first sliding sleeve 20 and the second sliding sleeve 30 may be independently and selectively movable between their respective closed and open sleeve positions.

Figure 3:
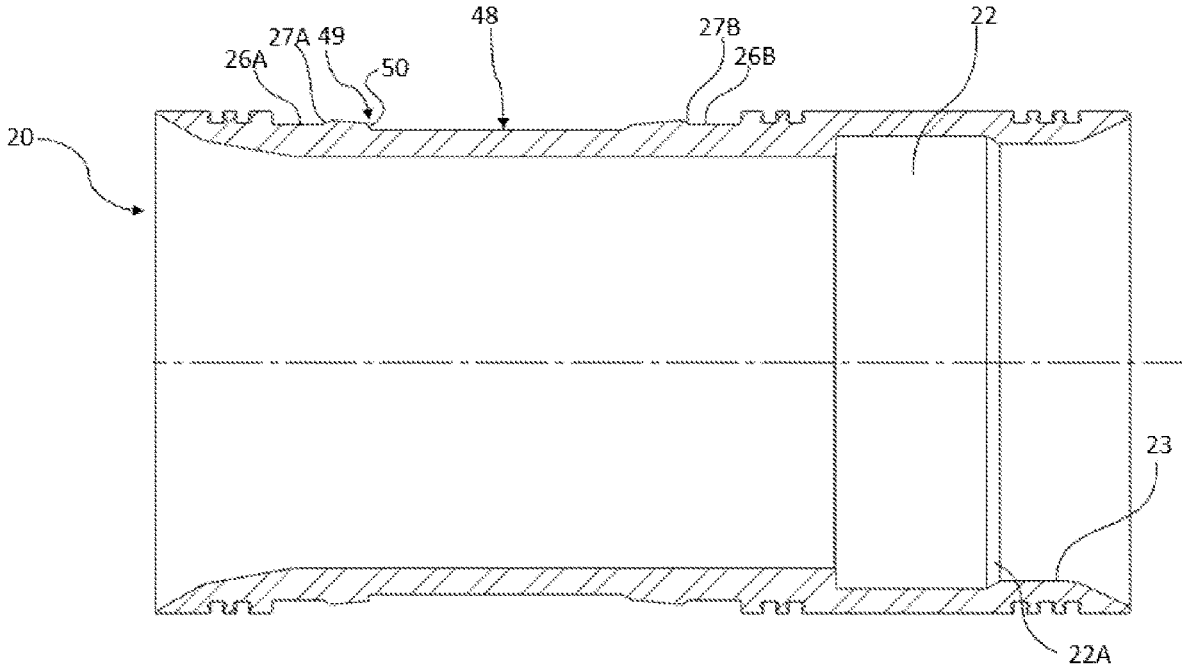
FIG. 3 is side cross-section view of an embodiment of a first sliding sleeve.

With reference to FIG. 3, the first sliding sleeve 20 has a first internal tool-engaging profile 22 for engaging with an actuating tool such that the first sliding sleeve 20 can be shifted to the open or closed first sleeve positions. In the example of FIG. 3, the first internal tool-engaging profile 22 comprises an annular first sleeve groove 22A recessed into an inner surface 23 of the first sliding sleeve 20.

Figure 4:
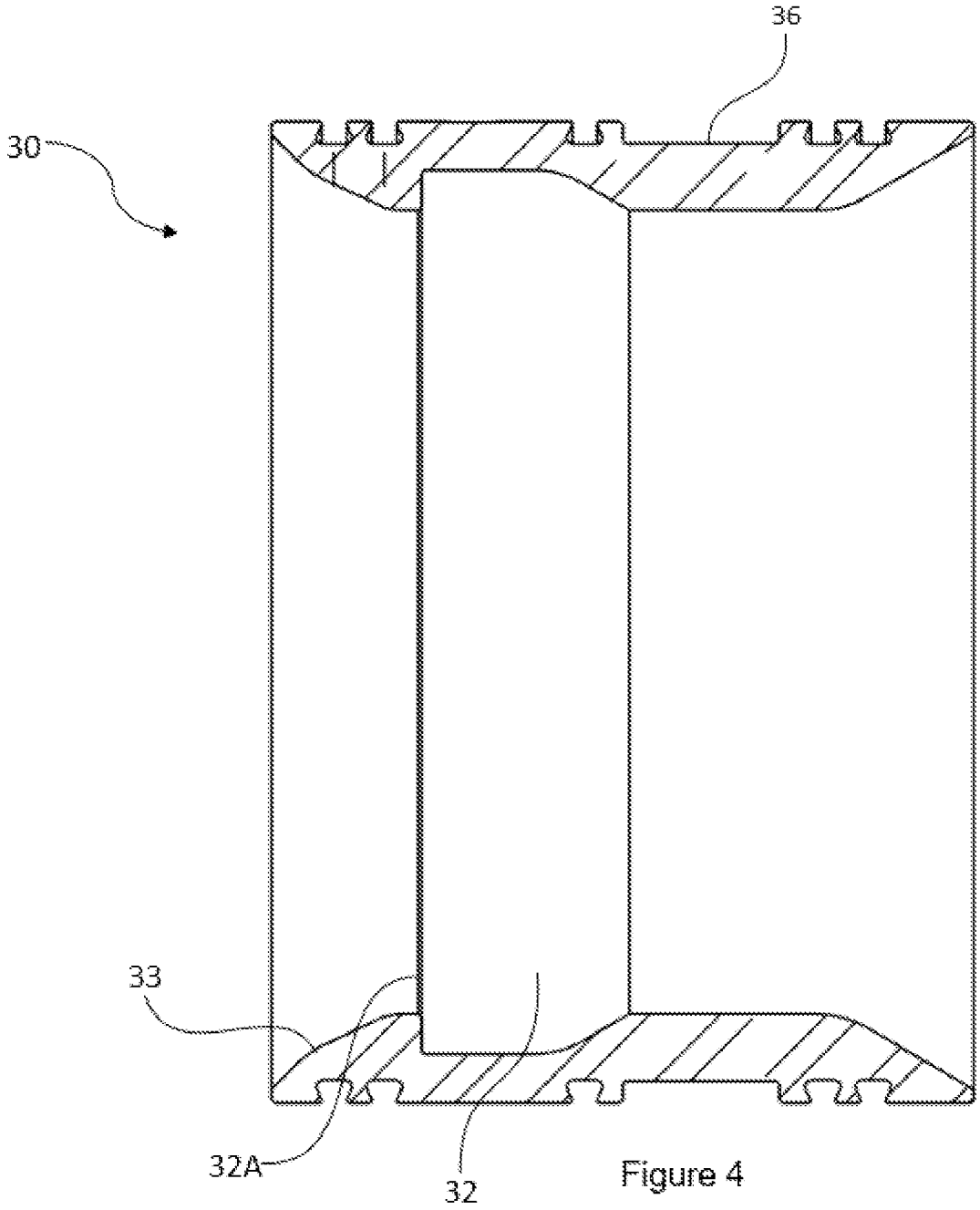
FIG. 4 is a side cross-section view of an embodiment of a second sliding sleeve.

With reference to FIG. 4, the second sliding sleeve 30 has a second internal tool-engaging profile 32 for engaging with the actuating tool such that the second sliding sleeve 30 can be shifted to the open or closed second sleeve positions. In the example of FIG. 4, the second internal tool-engaging profile 32 comprises an annular groove 32A recessed into an inner surface 33 of the second sliding sleeve 30. The dimensions of the second internal tool-engaging profile 32 can be different from the dimensions of the first internal tool-engaging profile 22, such that the second internal tool-engaging profile 32 is not accidentally engaged when it is desired to engage the first internal tool-engaging profile 22 for shifting of the first sliding sleeve 20. For example, the second internal tool-engaging profile 32 can have a shorter axial length than that of the first internal tool-engaging profile 22.

In some embodiments, both the first sliding sleeve 20 and the second sliding sleeve 30 are "pull to open" from the housing 10, such that they are pulled uphole by the actuating tool to the respective open positions.

The multi-position sleeve assembly 100 may comprise: a first detent mechanism that biases the first sliding sleeve 20 to remain in each of the open first sleeve position and the closed first sleeve position; and/or a second detent mechanism that biases the second sliding sleeve 30 to remain in each of the open second sleeve position and the closed second sleeve position. The first detent mechanism may, for example, comprise a first catch mechanism that biases the first sliding sleeve 20 in the closed first sleeve position until a downhole tool overcomes a biasing force of the catch mechanism and shifts the first sliding sleeve 20 to the open first sleeve position. The first catch mechanism may likewise bias the first sliding sleeve 20 to remain in the open first sleeve position. The second detent mechanism may comprise a second catch mechanism for similarly biasing the second sliding sleeve 30.

Referring to FIGS. 1A to 1C, the first detent mechanism in this embodiment comprises a first detent ring 18 mounted to the inner surface 10A of the housing 10 and positioned between the housing 10 and the first sliding sleeve 20. The first detent ring 18 is fixed to the housing 10 and comprises an annular protrusion 18A that is elastically deflectable. The first detent mechanism further comprises first and second annular detent grooves 26A and 26B (see FIG. 3). The first annular detent groove 26A is positioned to mate with the first detent ring 18 when the first sliding sleeve 20 is in the closed first sleeve position. Specifically, an annular shoulder 27A of the first annular detent groove 26A (best seen in FIG. 3) catches the annular protrusion 18A of the first detent ring 18 to bias the first sliding sleeve 20 to remain in the closed first sleeve position, shown in FIG. 1A. The second annular detent groove 26B is positioned to mate with the first detent ring 18 when the first sliding sleeve 20 is in the opened first sleeve position. Specifically, an annular shoulder 27B of the second annular detent groove 26B (best seen in FIG. 3) catches the annular protrusion 18A of the first detent ring 18 to bias the first sliding sleeve 20 to remain in the opened first sleeve position, shown in FIG. 1B. The biasing forces provided by the first detent ring 18 and the first and second annular detent grooves 26A and 26B may be overcome to shift the first sliding sleeve 20 between the opened first sleeve position and the closed first sleeve position.

Embodiments are not limited to the particular first detent mechanism described above, and any suitable detent mechanism to bias the first and/or second sliding sleeves 20,30 may be used in other embodiments. For example, the first detent ring 18 may instead be fixed to the first sliding sleeve 20 and may engage corresponding detent structures of the housing (e.g., annular grooves) to bias the first sliding sleeve 20.

Referring again to FIGS. 1A to 1C, the second detent mechanism in this embodiment comprises a second detent ring 34 mounted to the outer surface 36 of the second sliding sleeve 30 and positioned between the housing 10 and the second sliding sleeve 30. The second detent mechanism further comprises first and second annular detent recesses or grooves 17A and 17B (best seen in FIG. 2A) in the inner surface 10 of the housing 10. The first annular detent recess 17A is positioned to mate with the second detent ring 34 when the second sliding sleeve 30 is in the closed second sleeve position, shown in FIG. 1A. The second annular detent recess 17B is positioned to mate with the second detent ring 34 when the second sliding sleeve 30 is in the opened second sleeve position, shown in FIG. 1C. The biasing forces provided by the second detent ring 34 and the first and second annular detent recesses 17A and 17B may be overcome to shift the second sliding sleeve 30 between the open second sleeve position and the closed second sleeve position.

As shown in FIG. 1A, the second sliding sleeve 30 may comprise two or more annular seals 38, each annular seal 38 positioned in a respective groove, such as a dovetail groove, of the outer surface 36 of the second sliding sleeve 30 and for sealable engagement with the inner surface 10A of the housing 10. The annular seals 38 may be any suitable seal, such as an O-ring. When the second sliding sleeve 30 is in the closed second sleeve position, the one or more second ports 16 may be positioned between the two or more annular seals 38 and above the second detent ring 34 shown in FIG. 1A. This configuration may provide a barrier to undesired materials, for example debris or cement, entering through the one or more second ports 16 and reaching the second detent mechanism during, for example, cementing operations.

Embodiments are not limited to the particular first detent mechanism described above, and any suitable detent mechanism to bias the first and/or second sliding sleeves 20,30 may be used in other embodiments.

The detent mechanisms described above may prevent accidental shifting of the first and/or second sliding sleeves 20,30.

Figure 2B:
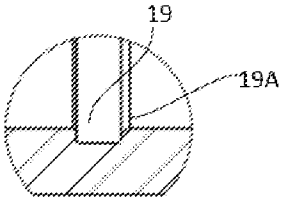
FIG. 2B is an enlarged cross-section view of the tubular housing withing circle B of FIG. 2A.

In some embodiments, the annular housing ring or detent 18 may be installed in the housing 10 using the first sliding sleeve 20. As one example, the detent ring 18 may initially be placed around the outer surface of the first sliding sleeve 20 in an annular recessed portion 48 between the annular grooves 26A and 26B (shown in FIG. 3). In this example, a shoulder or wall 50 (e.g., right angled shoulder) at an upper end 49 of the annular recessed portion 48 may "push" the detent ring 18 axially into position within the housing 10. The detent ring 18 is shaped to mate with grooves 19 in the inner surface 10A of the housing 10 (see FIG. 2A). When the detent ring 18 is pushed by shoulder 50 of the first sliding sleeve 20 into position over the grooves 19, the detent ring 18 may "snap" into the grooves, thereby locking the detent ring 18 into corresponding mating grooves 19 positioned on inner surface 10A such that the detent ring 18 becomes fixed relative to the housing 10. In some embodiments, the positioning of the detent ring 18 is facilitated by chamfered edge 19A (see FIG. 2B). In some embodiments, the detent ring 18 is permanently engaged with the inner surface 10A.

In some embodiments, shear screws may be used to retain the first and/or second sliding sleeves in their initial positions, such as retaining the first sliding sleeve 20 in the closed first sleeve position, and the second sliding sleeve 30 in the closed second sleeve position, until a requisite shear force is overcome to break the shear screws and shift the first or second sliding sleeve 20,30 to the respective open sleeve positions.

Figure 5:
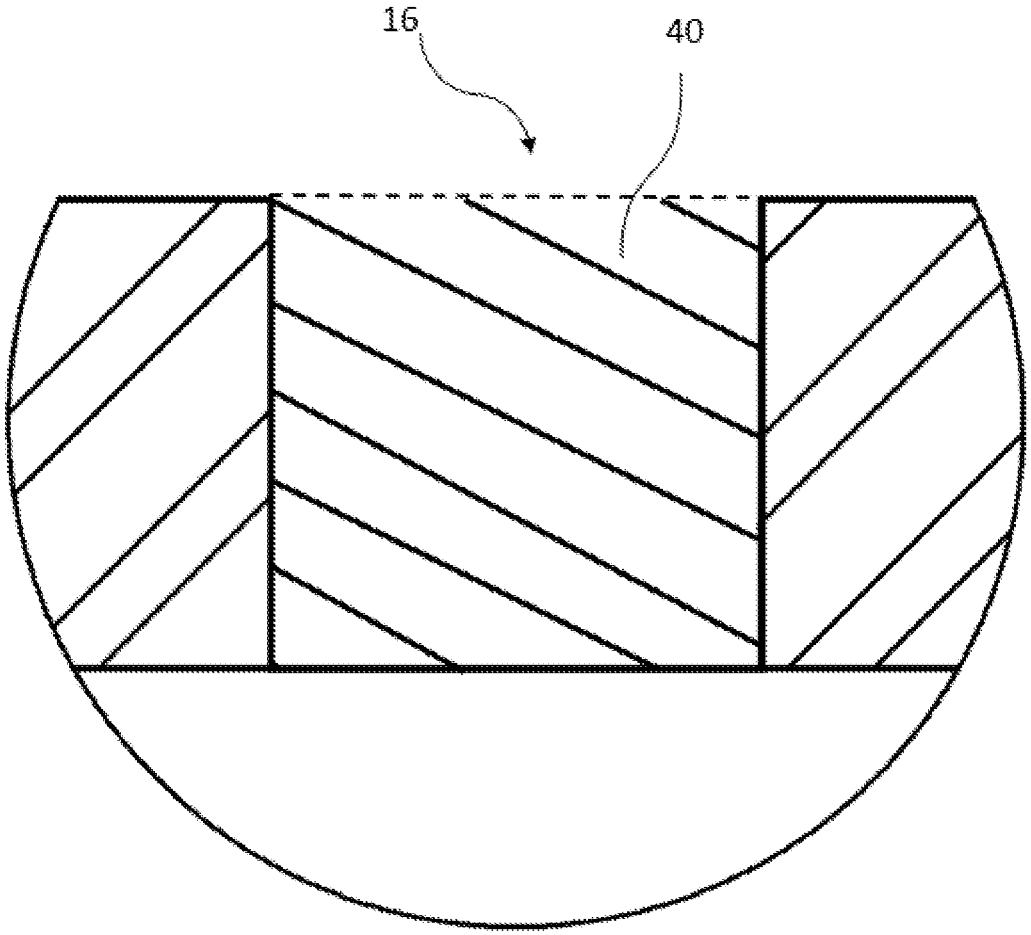
FIG. 5 is a side cross-section view of an embodiment of a removable plug occupying a second housing port.

In some embodiments, the multi-position sleeve assembly 100 disclosed herein may further comprise one or more removable plugs 40, each for occupying one of the one or more second ports 16 prior to first use (FIG. 5). The one or more plugs 40 may be of any suitable shape and size to occupy the one or more second ports 16 prior to first use. The one or more plugs 40 may be of any suitable material including, but not limited to, cement, cement inhibiting grease, plastic, composites, or elastomers. In a particular embodiment, the one or more plugs 40 comprise rubber.

Figure 6A:
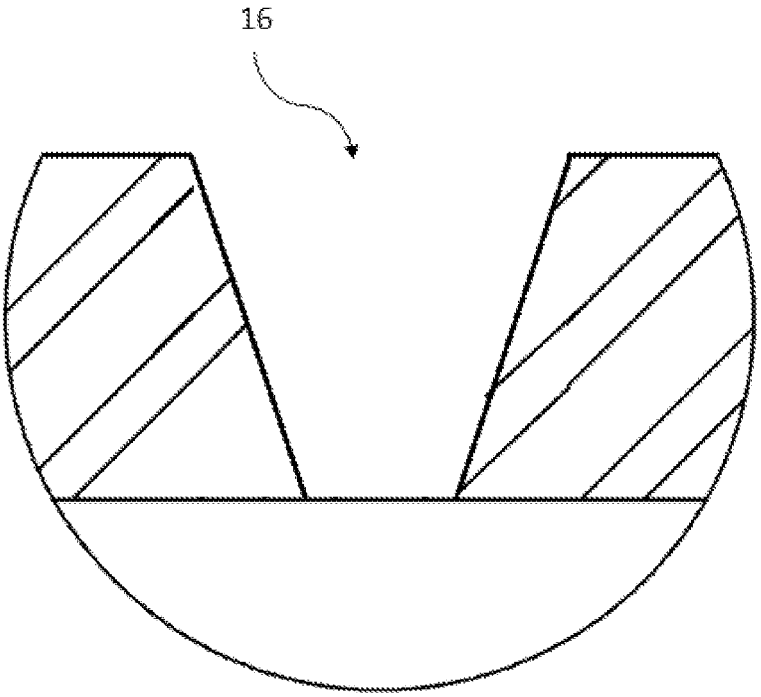
FIG. 6A is a side cross-section view of an embodiment of a second housing port having a tapered profile and FIG. 6B is a side cross-section view of an embodiment of a second housing port having a countersink hole profile according to some embodiments of the present disclosure.
Figure 6B:
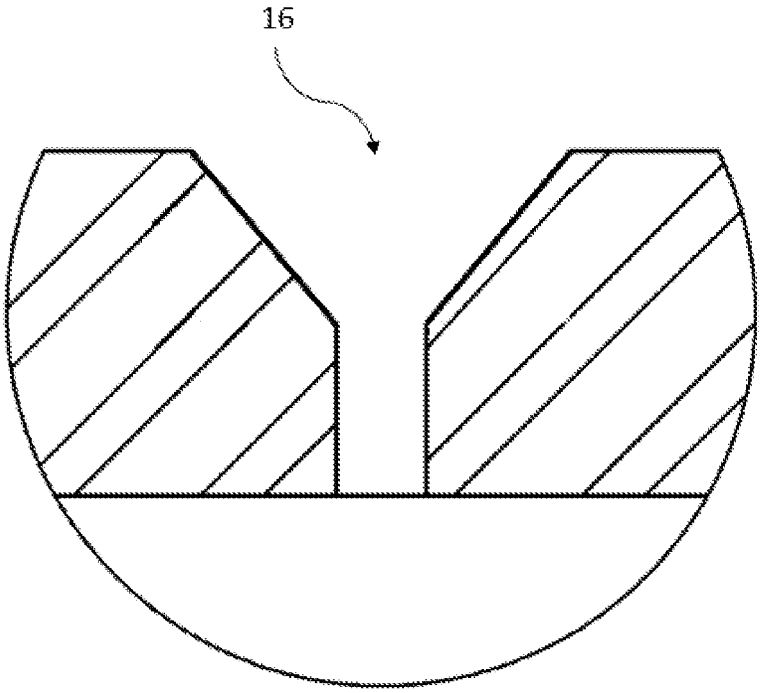

In some embodiments, the one or more second ports 16 have a tapered profile from the outer surface 10B to the inner surface 10A (see FIG. 6A). In some embodiments, the one or more second ports 16 have a countersink hole profile (see FIG. 6B). Without being bound by any particular theory, a tapered or a countersink hole profile may facilitate removal of the plug 40, if present, when the one or more second ports 16 are first used.

Figure 7A:
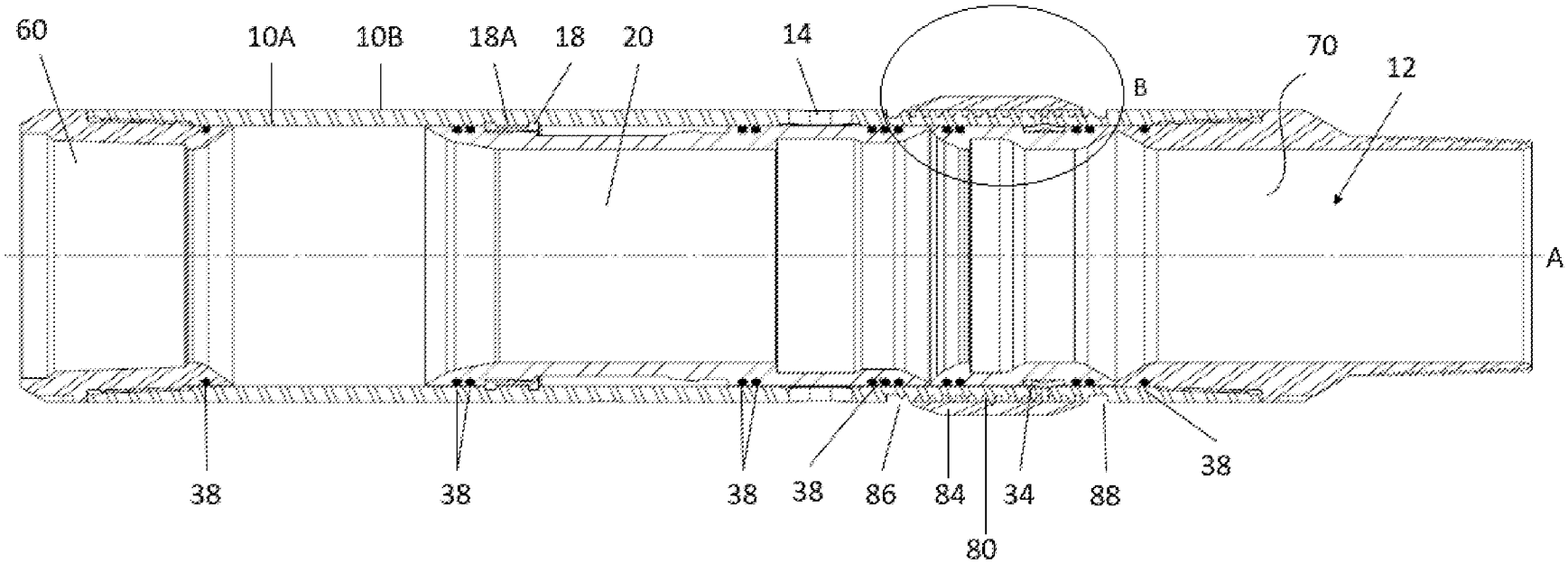
FIG. 7A is a side cross-section view of a portion of a multi-position sleeve assembly, according to some embodiments, having a helical groove defined in the outer surface of the tubular housing, and a sleeve positioned over the helical groove.
Figure 7B:
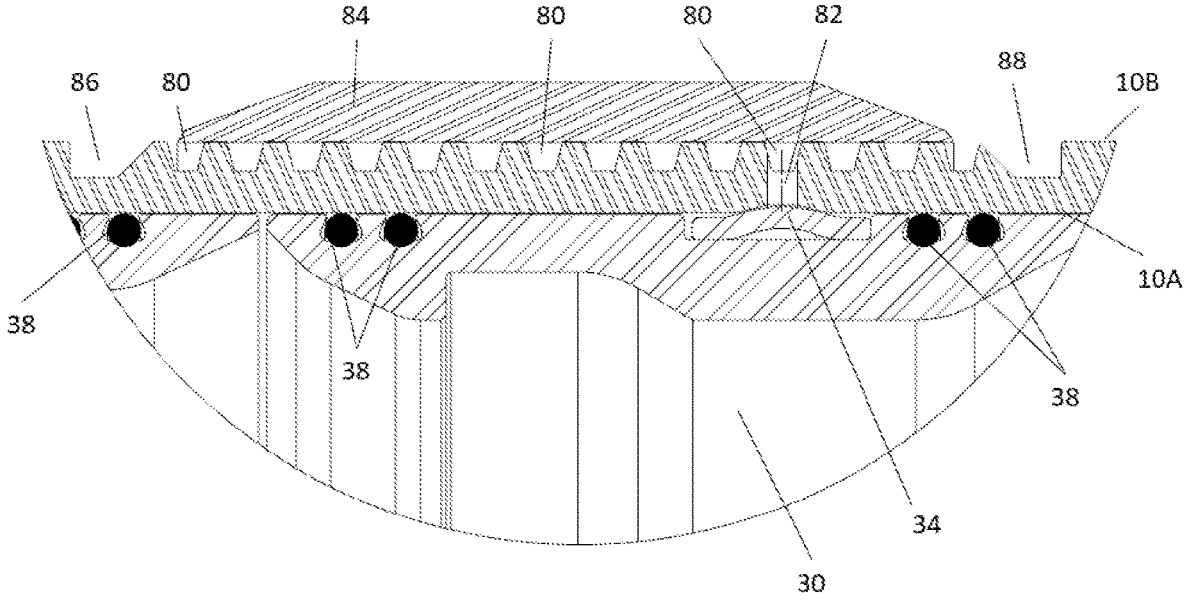
FIG. 7B is an enlarged cross-section view of the helical groove within circle B of FIG. 7A.

In some embodiments, a substantially helical groove 80 is formed on the outer surface 10B of the housing 10 (see FIGS. 7A-B). As used herein, "helical" means being in the shape of a helix that goes around a central tube in the form of a spiral. In some embodiments, the helical groove 80 has a frustoconical-shaped cross section. It is contemplated that the cross section of the helical groove 80 may vary in size and shape without departing from the scope of the invention. For example, in some embodiments, the land width, groove width, pitch, depth, and angle may vary. For example, in some embodiments, the helical groove 80 may have a square-shaped, rectangular-shaped, U-shaped, or semi-circular cross section. In some embodiments, the helical groove 80 may be circumferentially arranged about the outer surface 10B of the housing 10 and axially extend along a portion of the outer surface 10B of the housing 10. The helical groove 80 defines a pathway to allow the flow of fluid therethrough.

In some embodiments, a metering hole 82 is formed between the inner surface 10A and the outer surface 10B of the housing 10. In some embodiments, the metering hole 82 has a square cross section. It is contemplated that the cross section of the metering hole 82 may vary in size and shape without departing from the scope of the invention. For example, in some embodiments, the metering hole 82 may have a rectangular-shaped cross section. The metering hole 82 extends from the inner surface 10A to connect to the helical groove 80 for directing fluid to the helical groove 80. The metering hole 82 may allow metered fluid flow therethrough at an approximately known rate. The flow may be determined by the dimensions of the metering hole 82. In some embodiments, the metering hole 82 has a diameter larger than a sand grain to avoid plugging. In some embodiments, the metering hole 82 may have a diameter up to about 0.125. In some embodiments, the metering hole 82 may have a diameter up to about 0.200.

In some embodiments, a sleeve 84 is formed to cover the entirety of the helical groove 80, except its ends 86,88 which are exposed. The sleeve 84 may be circumferentially arranged about the helical groove 80. For example, during manufacture, the helical groove 80 may be cut into the outer surface 10B of the housing 10, and then covered by the sleeve 84 using a heat shrink technique. In some embodiments, the sleeve 84 may be relatively thin since it does not have to withstand high pressures. In some embodiments, the sleeve 84 may have a thickness of about 0.125 inch.

Figure 8A:
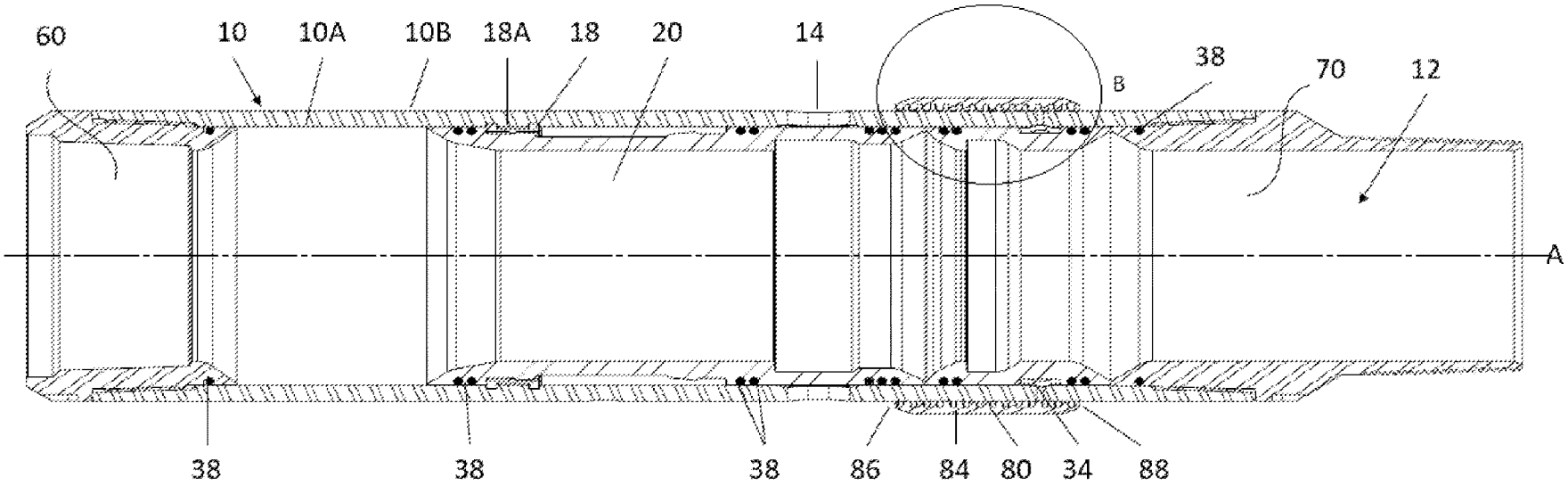
FIG. 8A is a side cross-section view of a portion of a multi-position sleeve assembly, according to some embodiments, having a sleeve defining a helical groove positioned over the outer surface of the tubular housing.
Figure 8B:
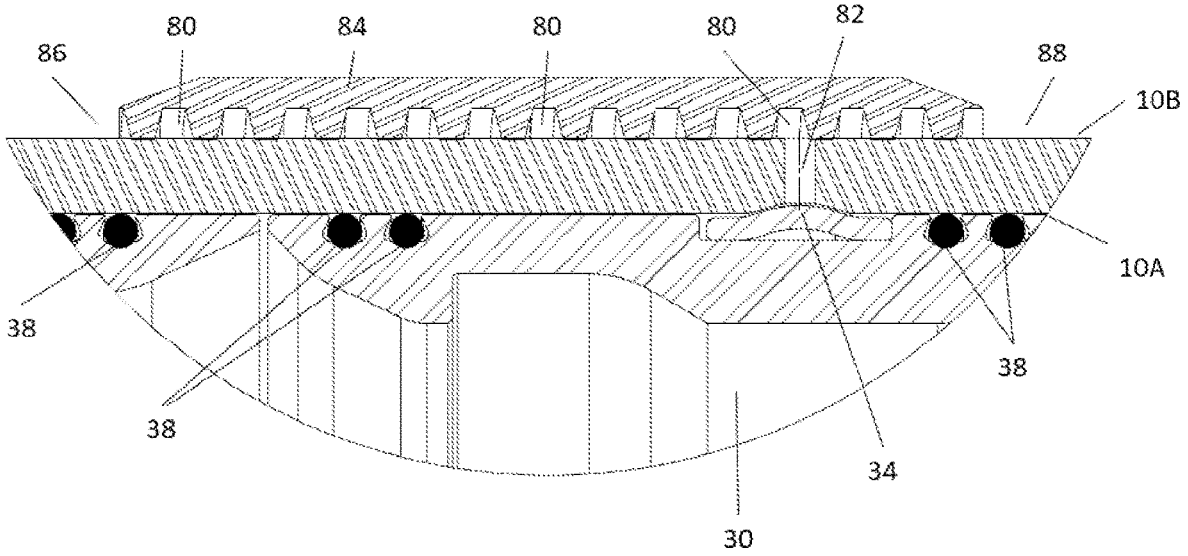
FIG. 8B is an enlarged cross-section view of the helical groove within circle B of FIG. 8A.

In some embodiments, the sleeve 84 is configured to define the helical groove 80 and its exposed ends 86,88, and is positioned over the outer surface 10B of the tubular housing 10 (see FIGS. 8A-B). For example, during manufacture, the helical groove 80 may be cut into the sleeve 84. In some embodiments, the helical groove 80 has a frusto-conical-shaped cross section. It is contemplated that the cross section of the helical groove 80 may vary in size and shape without departing from the scope of the invention. For example, in some embodiments, the land width, groove width, pitch, depth, and angle may vary. For example, in some embodiments, the helical groove 80 may have a square-shaped, rectangular-shaped, U-shaped, or semi-circular cross section.

In some embodiments, the sleeve 84 defining the helical groove 80 may be circumferentially arranged about the outer surface 10B of the housing 10 and axially extend along a portion of the outer surface 10B of the housing 10. For example, during manufacture, the sleeve 84 may be arranged about the outer surface 10B of the housing 10 using a heat shrink technique. In some embodiments, the sleeve 84 may be relatively thin since it does not have to withstand high pressures. In some embodiments, the sleeve 84 may have a thickness of about 0.125 inch. The helical groove 80 defines a pathway to allow the flow of fluid therethrough.

In some embodiments, the metering hole 82 is formed between the inner surface 10A and the outer surface 10B of the housing 10. In some embodiments, the metering hole 82 has a square cross section. It is contemplated that the cross section of the metering hole 82 may vary in size and shape without departing from the scope of the invention. For example, in some embodiments, the metering hole 82 may have a rectangular-shaped cross section. The metering hole 82 extends from the inner surface 10A to the outer surface 10B, and connects to the helical groove 80 within the sleeve 84 for directing fluid to the helical groove 80. The metering hole 82 may allow metered fluid flow therethrough at an approximately known rate. The flow may be determined by the dimensions of the metering hole 82. In some embodiments, the metering hole 82 has a diameter larger than a sand grain to avoid plugging. In some embodiments, the metering hole 82 may have a diameter up to about 0.125. In some embodiments, the metering hole 82 may have a diameter up to about 0.200.

In some embodiments as shown in FIGS. 7A-B and 8A-B, the helical groove 80 and sleeve 84 together define a closed fluid pathway therethrough on the outer diameter of the housing 10, with the sleeve 84 exposing the open ends 86,88 of the helical groove 80. When the first sliding sleeve 20 is in the open first position and the second sliding sleeve 30 is in the open second sleeve position (the third mode as shown in FIG. 1C), the helical groove 80 and sleeve 84 may lengthen the pathway through which the fluid flows, thereby creating a pressure drop. Fluid flows from the bore 12 and is directed through the metering hole 82 to the helical groove 80. The helical groove 80 allows the flow of the fluid therethrough in its pathway covered by the sleeve 84 until the fluid exits from the exposed ends 86,88 to the surrounding treatment zone.

These embodiments may be particularly useful for applications including, but not limited to, waterflooding, whereby water injection is used to increase the oil production rate and oil recovery. Water injection increases the pressure of a reservoir to its initial level and maintains it near that pressure to displace oil from the reservoir. Without being bound by any theory, it is contemplated that for waterflooding, multiple sleeve assemblies including helical grooves 80 and sleeves 84 when installed in tandem may define a lengthy pathway for the injection water before it is released outside of the sleeve assembly to the surrounding treatment zone, thereby generating a pressure drop sufficient to limit the injection rate and simultaneously allowing the same injection pressure through the entire length of the well.

The multi-position sleeve assembly disclosed herein may have different operational modes including, a first mode wherein the first sliding sleeve and the second sliding sleeve are each in the respective closed sleeve positions (FIG. 1A); a second mode wherein the first sliding sleeve is in the open first sleeve position and the second sliding sleeve is in the closed second sleeve position (FIG. 1B); and a third mode wherein the first sliding sleeve is in the open first sleeve position, the second sliding sleeve is in the open second sleeve position (FIG. 1C). In some embodiments, the one or more first ports are obstructed by the second sliding sleeve in the third mode, such as shown in FIG. 1C. In alternative embodiments, the first sliding sleeve may be in the closed sleeve position while the second sliding sleeve is in the open sleeve position to achieve an alternate third mode. In some embodiments, the multi-position sleeve assembly may have an alternate second mode, wherein the first sliding sleeve and the second sliding sleeve are both in the respective open sleeve positions and both the one or more first ports and the one or more second ports are not obstructed.

The sleeve assembly can be actuated to the various modes using a down hole actuator tool configured to actuate both the first and second sliding sleeves in a single run, or by running the down hole actuator downhole in a first run to actuating the first sliding sleeve, and then reconfiguring the down hole actuator and actuating the second sliding sleeve in a second run.

In an exemplary non-limiting operation, the first sliding sleeve can be actuated to the open first sleeve position to permit treatment of the surrounding formation while the second sliding sleeve is in the closed second sleeve position, and then the second sliding sleeve can be actuated to the open second sleeve position, wherein the one or more first ports are obstructed by the second sliding sleeve, when it is desired to convert the well from a producer well to an injector well, wherein water is injected into the formation at a reduced flow rate determined by the dimensions of the one or more second ports.

In this embodiment, the housing 10 comprises a first housing connector 60 partially received within the bore 12 and coupled to the uphole end of the housing 10, which acts as an upper stop for the first sliding sleeve 20 in the open first sleeve position. The second sliding sleeve 30 acts as a lower stop for the first sliding sleeve 20. The housing 10 comprises a second housing connector 70 partially received within the bore 12 and coupled to the downhole end of the housing 10, which acts as a lower stop for the second sliding sleeve 30 in the closed second sleeve position. The first sliding sleeve 20 acts as an upper stop for the second sliding sleeve 30. In alternate embodiments, the second housing connector 70 may be integral with the housing 10 and/or the first housing connector 60 may be integral with the housing 10.

The first and second sliding sleeves can be actuated using any suitable downhole actuator tool. For example, Applicant's U.S. Pat. No. 10,472,928, incorporated herein in its entirety by reference, discloses a down hole actuator tool for locating and actuating one or more sleeve valves spaced along a completion string. Applicant's U.S. Pat. No. 11,346,169, incorporated herein in its entirety by reference, discloses a downhole tool including a biased repositioning sub to reduce the number of tool cycles required to open a sleeve and treat the adjacent treatment zone. Applicant's U.S. Pat. No. 11,208,871, incorporated herein in its entirety by reference, discloses a downhole tool having a dual J-Mechanism also for reducing the number of required tool cycles. The down hole actuators of the down hole actuator tool may comprise dog arms, capable of locating the first sliding sleeve and the second sliding sleeve.

As mentioned above, an actuating tool can be used to actuate the first and second sliding sleeves 20,30 in a single run, or the first and second sliding sleeves 20,30 can be actuated in separate runs. In some embodiments, the actuating tool can be fit with first sleeve-engaging elements sized to correspond to the first tool-engaging profiles 22 of the first sliding sleeves 20. If the second tool-engaging profiles 32 of the second sliding sleeves 30 have a shorter axial length than that of the first profiles 22, the first sleeve-engaging elements of the actuating tool cannot inadvertently engage the second profiles 32. After the first sliding sleeves 20 have been actuated, the actuating tool can be fit with second sleeve-engaging elements sized to correspond to the second tool-engaging profiles 32 of the second sliding sleeves 30. The first sleeve-engaging elements may or may not need to be removed.

If both the first and second sliding sleeves 20,30 are actuated in a single run, the actuating tool can be fit with both the first and second sleeve-engaging elements and selectively activate first and second sleeve-engaging elements to respectively engage the first and second sleeve profiles 22,32, depending on which sleeves are to be shifted.

As described in further detail below, in some embodiments the actuating tool can be located below a target sleeve assembly, and therefore below the first and second sliding sleeves 20,30 thereof, and pulled uphole to locate the desired sleeve. As the first sleeve-engaging elements are configured such that they cannot fit into and engage with the second profiles 32 of the second sliding sleeve 30, when the actuating tool is configured to locate and shift the first sliding sleeve 20, the first sleeve-engaging elements will pass over the second profile of the second sliding sleeve 30 without engaging therewith as the tool is pulled towards the first sliding sleeve 20.

System and Operation

The present disclosure also relates to a system comprising two or more of any of the multi-position sleeve assemblies disclosed herein for use in a wellbore.

Further, the present disclosure relates to a method of actuating a multi-position sleeve system downhole, the method comprising: actuating a first sliding sleeve, using an actuating tool configured to engage the first sliding sleeve, from a closed first sleeve position obstructing one or more first ports to an open first sleeve position wherein the one or more first ports are not obstructed; and actuating a second sliding sleeve, using an actuating tool configured to engage the second sliding sleeve, from a closed second sleeve position obstructing one or more second ports to an open second sleeve position wherein the one or more second ports are not obstructed. In some embodiments, the second sliding sleeve obstructs the one or more first ports in the open second sleeve position.

In an exemplary embodiment of the operation of a multi-position sleeve assembly according to the present disclosure, a system comprising a plurality of the disclosed sleeve assemblies is located along the casing of the wellbore. In a first run, the down hole actuator tool is fit with first sleeve-engaging elements, such as dogs, configured to engage the first sleeve profiles and sized be too large to fit into the second sleeve profiles of the second sliding sleeves. The first and second sliding sleeves are in the respective closed sleeve positions and, therefore, in the first mode. The actuator tool is run in hole below a target sleeve assembly. The actuating tool is then actuated to a locate mode to bias the dogs radially outwards, and the tool is pulled uphole to locate the first sleeve profile. The dogs pass over the second sleeve profile of the second sliding sleeve, as they are too large to fit into the second profile, and continue uphole until reaching the first sleeve profile of the first sliding sleeve, at which point the dogs engage with the first sleeve profile. While the dogs are engaged with the first sleeve profile, the actuating tool continues to be pulled upward such that the first sliding sleeve is pulled to the open position by the first dogs. The sleeve assembly is now in the second mode. After the first sliding sleeve is actuated to the open position, the actuating tool can be actuated to a set mode wherein a packer of the actuating tool is positioned and set below the housing bores of the target sleeve assembly. Fracturing fluid is then provided into the casing bore and flows out of the housing ports to the treatment area. Once the treatment with fracturing fluid is complete, the first sliding sleeve of the sleeve assembly can be returned to the closed first sleeve position by the actuating tool or left in the open first sleeve position. The actuating tool can then be positioned below a subsequent sleeve assembly uphole of the present sleeve assembly, and the above process is repeated to actuate the subsequent sleeve assembly to the open position. This process can be repeated until all desired first sliding sleeves of the multi-position sleeve assemblies are actuated to the open first sleeve position.

As discussed elsewhere herein, the sleeve assembly is in a third mode, or a restricted fluid flow mode, when the second sliding sleeve is in the open second sleeve position and the one or more first ports are obstructed. The third mode is generally used when a well is converted from a producing well to an injector well, or in any other situation wherein it is desired to introduce fluid into the formation in a restricted or metered manner. Without being bound by any particular theory, the third mode may provide a more predicable fluid flow across multiple sleeve assemblies or multiple stages because the restricted flow through the at one or more second ports may provide less of a pressure drop compared to that provided by fluid flow through the one or more first ports.

To actuate the sleeve assemblies to the third mode, the actuating tool can be pulled back up to surface and fit with second sleeve-engaging members, such as dogs, for engaging the second sliding sleeve profiles. Such second sleeve-engaging members can be axially shorter than the first sleeve-engaging members such that they can fit into the second sleeve profiles. The actuating tool can then be run back downhole to a target sleeve assembly to actuate the assembly to the third mode in the same manner as for the first sliding sleeves. Since the second sliding sleeve is downhole of the first sliding sleeve, when the actuating tool is actuated to the locate mode and pulled uphole, the dogs will first encounter the second sliding sleeve and engage with the second sleeve profile. The process above can be followed to pull the actuating tool uphole to actuate the second sliding sleeve to the open second sleeve position. Subsequent sleeve assemblies can be located and the second sliding sleeves shifted to the third mode in the same manner.

In other embodiments, the first and second sliding sleeves can both be respectively shifted to the second mode and the third mode on the initial run. For example, the actuating tool can be fit with both first and second sleeve-engaging elements and is capable of selectively actuating the elements to locate and move the first and second sliding sleeves of the sleeve assemblies.

While various embodiments and examples have been described herein, it should be understood that this is by way of illustration only and the apparatus, system and method are not intended to be limited to these embodiments. On the contrary, this disclosure is intended to cover alternatives, modifications, and equivalents which will become apparent to those skilled in the art in view of this disclosure.

The invention claimed is:

1. A multi-position sleeve assembly for use in a wellbore, comprising:

a tubular housing defining a bore axially therethrough, the housing having an inner surface and an outer surface and defining one or more first ports and one or more second ports from the inner surface to the outer surface, the one or more second ports spaced axially from the one or more first ports;

a first sliding sleeve located in the bore and coaxial with the housing, the first sliding sleeve axially actuable relative to the housing between a closed position wherein the first sliding sleeve obstructs the one or more first ports, and an open position wherein the first sliding sleeve does not obstruct the one or more first ports;

a second sliding sleeve located in the bore and coaxial with the housing, the second sliding sleeve axially actuable relative to the housing between a closed position wherein the second sliding sleeve obstructs the one or more second ports, and an open position wherein the second sliding sleeve does not obstruct the one or more second ports, wherein the one or more second ports are configured for restricted fluid flow relative to the one or more first ports; and either (i) a helical groove defined in the outer surface of the housing, and circumferentially arranged about the outer surface and axially extending along a portion of the outer surface, and a sleeve configured to be circumferentially arranged about the helical groove and exposing open ends of the helical groove;

or (ii) a sleeve configured to be circumferentially arranged about the outer surface of the housing and axially extending along a portion of the outer surface, the sleeve defining the helical groove and the open ends of the helical groove;

wherein the helical groove is connected to a metering hole defined between the inner surface and the outer surface of the housing, and the sleeve and helical groove together define a closed fluid pathway therethrough on the outer surface of the housing.

2. The multi-position sleeve assembly of claim 1, wherein the second sliding sleeve is positioned downhole relative to the first sliding sleeve.

3. The multi-position sleeve assembly of claim 1, wherein the one or more first ports comprise two or more first ports.

4. The multi-position sleeve assembly of claim 3, wherein the two or more first ports are circumferentially arranged about the housing.

5. The multi-position sleeve assembly of claim 4, wherein the two or more first ports encircle the longitudinal axis of the housing.

6. The multi-position sleeve assembly of claim 1, wherein the one or more second ports comprise two or more second ports.

7. The multi-position sleeve assembly of claim 6, wherein the two or more second ports are circumferentially arranged about the housing.

8. The multi-position sleeve assembly of claim 7, where in the two or more second ports encircle the longitudinal axis of the housing.

9. The multi-position sleeve assembly of claim 1, wherein when the first sliding sleeve is in the open position and the second sliding sleeve is in the open position, the second sliding sleeve obstructs the one or more first ports.

10. The multi-position sleeve assembly of claim 1, wherein the one or more second ports have a diameter between about 0.040 inch and about 0.375 inch.

11. The multi-position sleeve assembly of claim 10, wherein the diameter is 0.0625 inch.

12. The multi-position sleeve assembly of claim 1, wherein the one or more second ports have a tapered profile from the outer surface to the inner surface.

13. The multi-position sleeve assembly of claim 1, wherein the one or more second ports have a countersink hole profile.

14. The multi-position sleeve assembly of claim 1, further comprising one or more removable plugs, each for occupying one of the one or more second ports prior to first use.

15. The multi-position sleeve assembly of claim 14, wherein the one or more plugs comprise rubber.

16. The multi-position sleeve assembly of claim 1, wherein the outer surface of the housing further defines one or more axial grooves, each axial groove extending between a respective one of the one or more first ports and a respective one of the one or more second ports.

17. A method of actuating the multi-position sleeve system of claim 1, the method comprising:

actuating the first sliding sleeve from the closed first sleeve position to the open first sleeve position; and actuating the second sliding sleeve from the closed second sleeve position to the open second sleeve position.

18. The method according to claim 17, wherein the one or more second ports are not obstructed and wherein the second sliding sleeve obstructs the one or more first ports in the open second sleeve position.

* * * * *